US008698382B2

(12) United States Patent
Osada

(10) Patent No.: US 8,698,382 B2
(45) Date of Patent: Apr. 15, 2014

(54) SOCKET AND LUMINAIRE

(75) Inventor: Takeshi Osada, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/821,529

(22) PCT Filed: Sep. 27, 2011

(86) PCT No.: PCT/JP2011/072119

§ 371 (c)(1),
(2), (4) Date: Mar. 7, 2013

(87) PCT Pub. No.: WO2012/043585

PCT Pub. Date: Apr. 5, 2012

(65) Prior Publication Data

US 2013/0181594 A1 Jul. 18, 2013

(30) Foreign Application Priority Data

Sep. 27, 2010 (JP) ..... 2010-215984
Dec. 27, 2010 (JP) ..... 2010-289818

(51) Int. Cl.
*H01J 5/48* (2006.01)
*H01J 5/50* (2006.01)

(52) U.S. Cl.
USPC ..... 313/51; 313/49; 313/50

(58) Field of Classification Search
None
See application file for complete search history.

(56) References Cited

U.S. PATENT DOCUMENTS 7,717,580 B2 * 5/2010 Takata et al. ..... 362/97.1

FOREIGN PATENT DOCUMENTS

| | | | |
|---|---|---|---|
| JP | 8190973 | A | 7/1996 |
| JP | 3152509 | A | 8/2009 |
| JP | 2010171021 | A | 8/2010 |

OTHER PUBLICATIONS

International search report for application No. PCT/JP2011/072119 dated Nov. 8, 2011.

* cited by examiner

*Primary Examiner* — Natalie Walford
(74) *Attorney, Agent, or Firm* — Patterson & Sheridan, LLP

(57) ABSTRACT

A socket is configured to hold a straight tube type lamp including an earth pin including a leg portion, and a holding portion formed at a distal end of the leg portion, formed into an oval shape and having a diameter larger than that of the leg portion. The socket includes a socket body, a guiding device, and terminals. The socket body includes an insertion port having a dimension larger than a short diameter dimension of the oval shape of the holding portion of the earth pin and a notched portion communicating from the insertion port to a predetermined holding position P where the earth pin is held and allowing the leg portion of the earth pin to be inserted therethrough. The guiding device is configured to guide the holding portion to the predetermined holding position P by a rotation of the earth pin between the insertion port and the predetermined holding position P. The terminals hold the holding portion of the earth pin at the predetermined holding position P.

13 Claims, 15 Drawing Sheets

SOCKET AND LUMINAIRE

TECHNICAL FIELD

Embodiments of the present invention relates to a socket configured to hold a straight tube type lamp including an earth pin including a leg portion and a holding portion formed at a distal end of the leg portion and having an oval shape and a diameter larger than the leg portion, and a luminaire using the socket.

BACKGROUND ART

In general, a luminaire using a straight tube type fluorescent lamp including G13-type bases each having a pair of lamp pins having a circular shape in cross-section and projecting therefrom at both ends thereof, and sockets for connecting the fluorescent lamp is widely used.

There is also proposed a straight tube type lamp using LED elements. The straight tube type lamps of this type include a straight tube type lamp provided with a cap referred to as an L-shape of a new standard in addition to the straight tube type lamp using the G13-type bases in the same manner in the related art.

The straight tube type lamp provided with the cap referred to as the L-shape of the new standard includes a cap on the power supply side at one end thereof and a cap on the earth side at the other end thereof. The cap on the earth side is formed with one earth pin having a leg portion and a holding portion formed at a distal end of the leg portion and having an oval shape and a diameter larger than the leg portion so as to project therefrom.

A socket on the power supply side and a socket on the earth side specific for such a straight tube type lamp are used. The socket on the earth side is configured to hold the holding portion of the earth pin by means of a terminal in a socket body by inserting the earth pin from a distal end side of the socket body into a predetermined holding position and rotating the earth pin at the holding position.

CITATION LIST

Patent Literature

PTL1: Japanese Registered Utility Model No. 3152509

SUMMARY OF INVENTION

Technical Problem

With the socket configured to mount the straight tube type lamp by inserting the earth pin thereof into the socket and rotating the same therein, if the earth pin is rotated in a state of being inserted incompletely with respect to the socket body, the earth pin cannot be mounted on the predetermined holding position.

A problem that the present invention is to solve is to provide a socket which allows an earth pin of a straight tube type lamp to be mounted at a predetermined holding position, and a luminaire using the socket having such a configuration.

Solution to Problem

A socket of the embodiment is configured to hold a straight tube type lamp including an earth pin including a leg portion, and a holding portion formed at a distal end of the leg portion, formed into an oval shape, and having a diameter larger than the leg portion. The socket includes a socket body, a guiding device, and terminals. The socket body includes an insertion port having a dimension larger than a short diameter dimension of the oval shape of the holding portion of the earth pin and a notched portion communicating from the insertion port to a predetermined holding position where the earth pin is held and allowing the leg portion of the earth pin to be inserted therethrough. The guiding device is configured to guide the holding portion to the predetermined holding position by a rotation of the earth pin between the insertion port and the predetermined holding position. The terminals hold the holding portion of the earth pin at the predetermined holding position.

DESCRIPTION OF EMBODIMENTS

Figure 1:
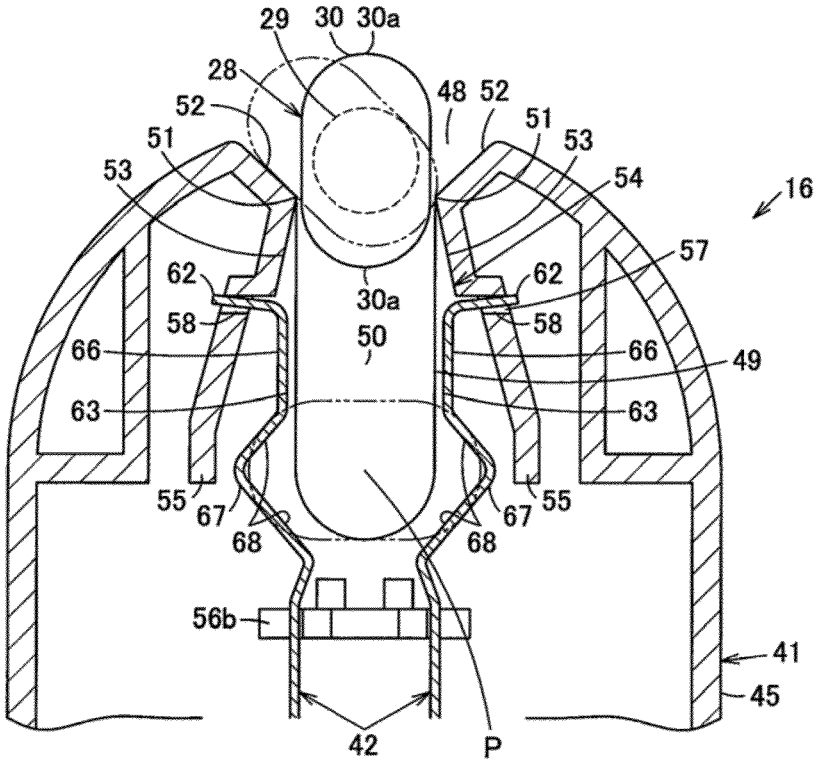
FIG. 1 is a cross-sectional view for explaining an earth pin ejecting action of a socket according to a first embodiment.

Referring now to the drawings, a first embodiment will be described with reference to FIG. 1 to FIG. 7.

Figure 6:
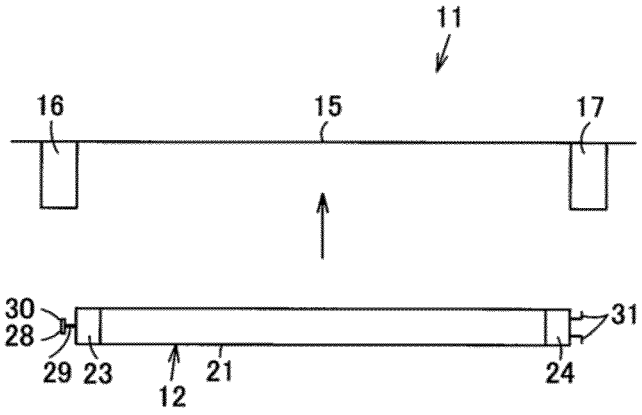
FIG. 6 is a side view of a luminaire in which the same socket is used.
Figure 7:
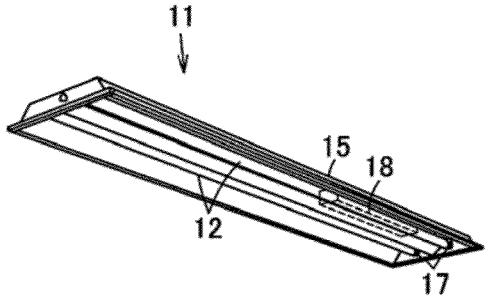
FIG. 7 is a perspective view of the same luminaire.

FIG. 6 and FIG. 7 illustrate a luminaire 11, which is a recessed luminaire of a two straight tube type fluorescent lamp type, and two straight tube type lamps 12 are used in the luminaire 11.

The luminaire 11 includes an elongated luminaire body 15 of a lower side opening type which is configured to be installed in a recessed ceiling surface, two sets of sockets 16, 17 arranged at both ends of the luminaire body 15 in the longitudinal directions so as to oppose each other and to which end portions of the respective straight tube type lamps 12 are mounted, and a lighting apparatus 18 arranged in the luminaire body 15 and configured to light the straight tube type lamps 12. The sockets 16 on one end side to which one end sides of the straight tube type lamps 12 are mounted correspond to a non-power supply side, which is an earth side, and the sockets 17 on the other end side to which the other end sides of the straight tube type lamps 12 are mounted correspond to a power supply side. Each of the sockets 16 on the earth side serves either both as an earth connection and as a mount of the straight tube type lamp 12, or only as a mount of the straight tube type lamp 12, and both cases are possible.

Figure 5:
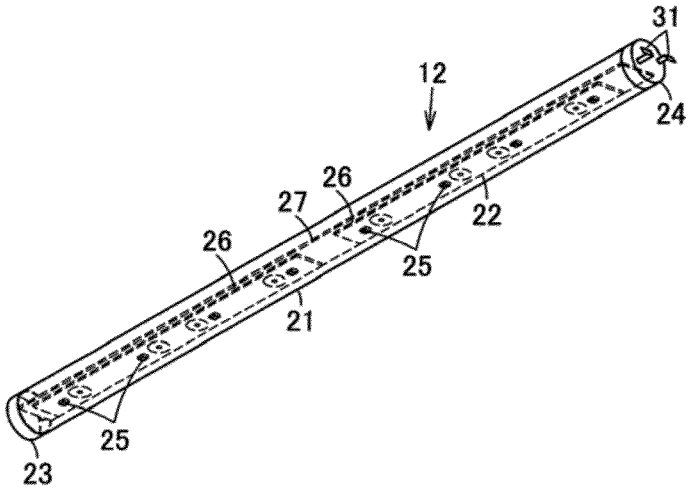
FIG. 5 is a perspective view of the same straight tube type lamp.

As illustrated in FIG. 5, the straight tube type lamp 12 includes a translucent cover 21, which is a tube formed into a straight tube shape having approximately the same tube length and the tube diameter as a light-emitting tube of the straight tube type fluorescent lamp, a light-source unit 22 housed in the translucent cover 21, and caps 23, 24 provided respectively at both end portions of the translucent cover 21. The cap 23 on one end side of the straight tube type lamp 12 corresponds to an earth side which is a non-power supply side which is mounted in the socket 16 on the earth side, and the cap 24 on the other end side of the straight tube type lamp 12 corresponds to a power-supply side which is mounted in the socket 17 for a power supply. The cap 23 on the earth side serves either both as an earth connection and a mount with respect to the socket 16, or only as a mount with respect to the socket 16, and both cases are possible.

The light source unit 22 includes a plurality of substrates 26 on which a plurality of semiconductor light-emitting elements 25 such as LED elements or EL elements are mounted, and a mounting plate 27 on which these substrates 26 are mounted. In the case of the LED elements, a method of mounting a plurality of SMD (Surface Mount Device) packages each provided with a connecting terminal formed by mounting LED chips on the substrate 26 or a COB (Chip On Board) method in which a plurality of LED elements are mounted on the substrate 26 are used as a method of mounting the semiconductor light-emitting elements 25.

Figure 3:
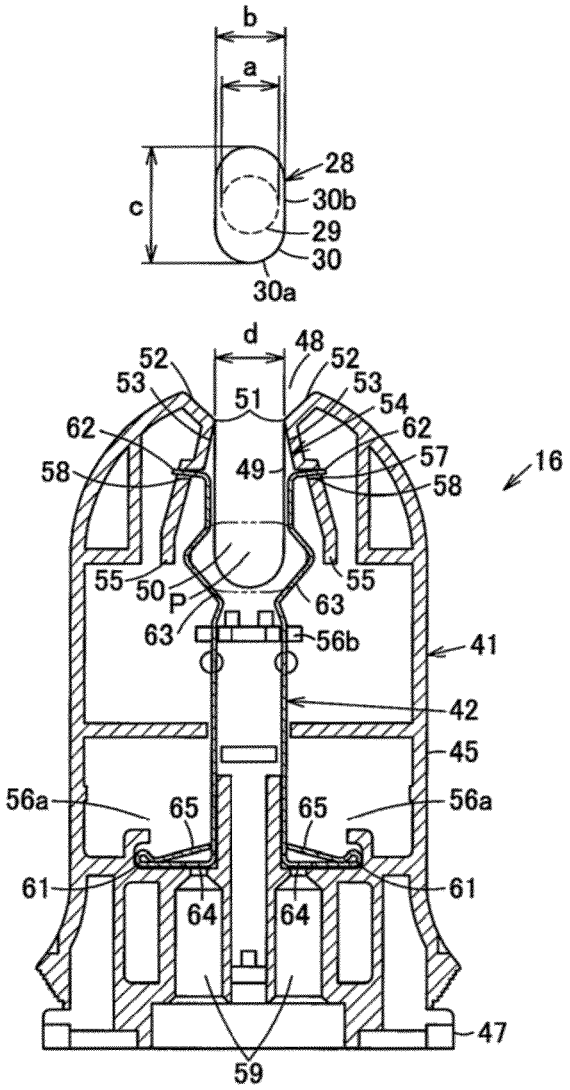
FIG. 3 is a cross-sectional view of the same socket.
Figure 4:
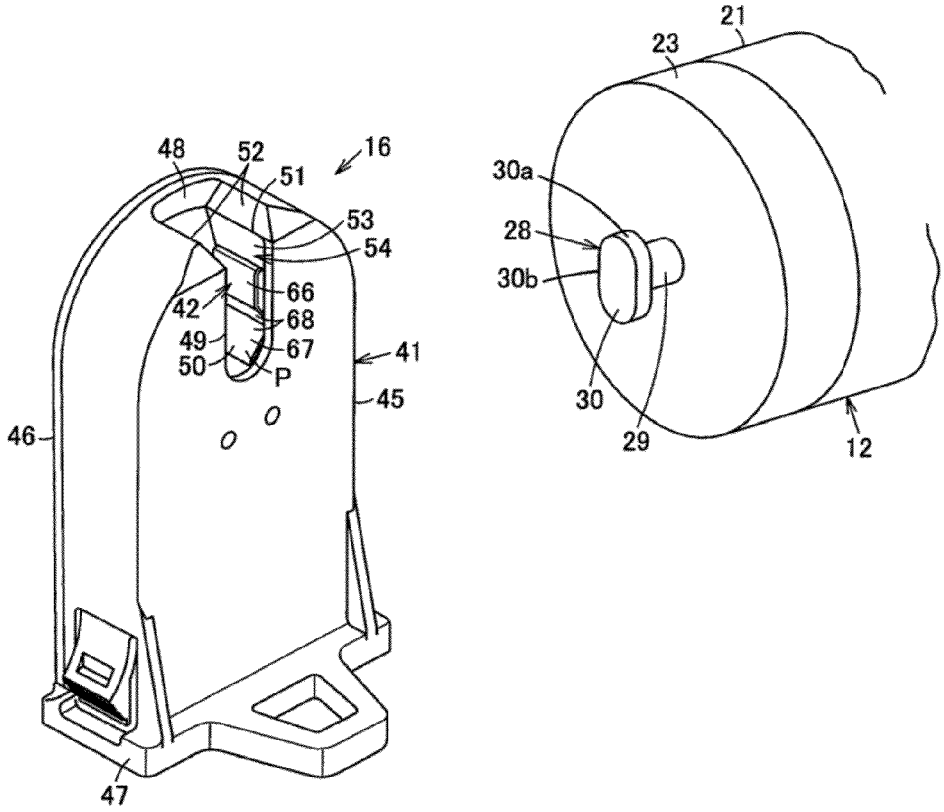
FIG. 4 is a perspective view illustrating parts of the same socket and a straight tube type lamp.

As illustrated in FIG. 4, an (one) earth pin 28 projects from an end surface of the cap 23 on the earth side at an axial center of the tube. The earth pin 28 includes a column-shaped leg portion 29 projecting from the cap 23 and an oval-shaped (ellipsoidal-shaped) holding portion 30 provided at a distal end of the leg portion 29. Both end surfaces of the holding portion 30 in the longitudinal direction (the long diameter direction) are formed into arcuate surfaces 30*a*, and both side surfaces in the short side direction (short diameter direction) are formed into straight surfaces 30*b* between these both end surfaces. As illustrated in FIG. 3, a dimensional relationship $a<b<c$ is satisfied, where a is a diameter of the leg portion 29, b is a short diameter dimension of the holding portion 30 in the short side direction, and c is along diameter dimension of the holding portion 30 in the longitudinal direction. As a detailed example of the dimensions of the holding portion 30, the short diameter dimension b of the holding portion 30 is 4 mm and the long diameter dimension c of the holding portion 30 is 8 mm.

As illustrated in FIG. 5 and FIG. 6, an end surface of the cap 24 for power supply is formed with a pair of lamp pins 31 for power supply electrically connected to the light source unit 22 so as to project therefrom.

In the straight tube type lamp 12, the longitudinal direction of the holding portion 30 of the earth pin 28 and the direction in which the pair of lamp pins 31 are arranged match, and a surface parallel to these directions and a light-emitting surface of the semiconductor light-emitting element 25 of the light source unit 22 extend in parallel to each other. In other words, the straight tube type lamp 12 is provided so that light from the light-emitting surface of the semiconductor light-emitting element 25 of the light source unit 22 can be irradiated in a predetermined direction of irradiation in a state in which the straight tube type lamp 12 is mounted correctly between the sockets 16, 17.

As illustrated in FIG. 6, a rotational mounting system for mounting the straight tube type lamp 12 by inserting the earth pin 28 and the lamp pins 31 from distal end surfaces of the sockets 16, 17 and rotating the straight tube type lamp 12 by 90 about a tube axis thereof is employed.

Subsequently, FIG. 1 to FIG. 4 illustrate the socket 16 on the earth side. The socket 16 includes a socket body 41, and a pair of terminals 42 to be arranged in the socket body 41. In the description given below, the side of the socket 16 which is mounted on the luminaire body 15 is referred to as a proximal end, the side opposite thereto is referred to as a distal end, a surface opposing the end surface of the straight tube type lamp 12 is referred to as a front surface, the side opposite thereto is referred to as a back surface, and portions between the front surface and the back surface are referred to as side surfaces.

The socket body 41 is formed of synthetic resin having insulating properties and includes a case 45 opening on the back surface side, and a cover 46 mounted on the back surface of the case 45.

A proximal end of the case 45 is formed with a mounting portion 47 which is to be mounted on the luminaire body 15, a distal end surface of the case 45 is formed with an insertion port 48 which allows insertion of the earth pin 28, a front surface of the case 45 is formed with a groove-shaped notched portion 49 communicating from the insertion port 48 to a predetermined holding position P where the earth pin 28 is held, and an earth pin insertion area 50 which allows insertion of the earth pin 28 from the insertion port 48 to the holding position P is formed in the interior of the case 45. The width dimension of the insertion port 48 is larger than the short diameter dimension b of the holding portion 30 of the earth pin 28 and the width dimension of the notched portion 49 between both sides thereof is larger than the diameter of the leg portion 29 so as to allow insertion of the leg portion 29.

The case 45 is integrally formed with a pair of narrow portions 51 on inner both sides of the insertion port 48, and is integrally formed with a pair of insertion port-side inclined portions 52 increasing the distance therebetween from the pair of narrow portions 51 toward an opening of the insertion port 48. The insertion port-side inclined portions 52 are formed into a flat surface or a curved surface along the direction of outward extension. A width dimension d of the pair of narrow portions 51 (see FIG. 3), which is a minimum dimension between the pair of insertion port-side inclined portions 52, is smaller than the long diameter dimension c of the holding portion 30 of the earth pin 28, and is larger than the short diameter dimension b. The pair of narrow portions 51 are preferably formed of corner portions, but may be formed into a curved surface extending along the direction of insertion of the earth pin 28 into the insertion port 48 or into a flat surface as long as the dimension thereof is smaller than the length dimension of the straight surface 30*b* of the holding portion 30.

The case 45 is integrally formed with a pair of guiding inclined portions 53 extending from the pair of narrow portions 51, which are end sides opposite to the insertion port 48 of the pair of insertion port-side inclined portions 52 outward toward an inner side opposite to the insertion port 48, which is the holding position P where the earth pin 28 is held. The pair of guiding inclined portions 53 are configured as a guiding device 54 which guides the holding portion 30 to the holding position P when the earth pin 28 is rotated in a state of being located between the insertion port 48 and the holding position P, which is an incomplete state of insertion.

The case 45 is integrally formed with a pair of restricting walls 55 increasing the distance therebetween toward an inner side opposite to the insertion port 48, which is the holding position P where the earth pin 28 is held on the end side opposite to the insertion port 48 of the pair of guiding inclined portions 53. The pair of restricting walls 55 are configured to restrict terminal strip portions 63 of the pair of terminals 42 from resiliently deforming outward of the earth pin insertion area 50 at predetermined positions, and are formed outside of the guiding inclined portions 53 so as to allow the terminal strip portions 63 of the pair of terminals 42 to resiliently deform outward of the earth pin insertion area 50.

The case 45 is formed with a pair of terminal holding portions 56*a* configured to hold the proximal sides of the pair of terminals 42 and terminal supporting portions 56*b* configured to support intermediate portions of the pair of terminals 42, and is formed with a supporting device 57 configured to support distal end sides of the pair of terminals 42. The supporting device 57 is composed of supporting grooves 58 formed between the guiding inclined portions 53 and the restricting walls 55, and is configured to support end portions of the terminals 42 on the side of the insertion port 48, which are distal ends of the terminals 42 inserted into the supporting grooves 58. Earth cable insertion holes 59 communicating with the respective terminal holding portions 56*a* are formed at the proximal end of the case 45.

The cover 46 to be mounted on the back surface of the case 45 closes the back surface of the case 45, and holds the pair of terminals 42 stored in the case 45 with respect to the case 45.

The pair of terminals 42 are formed of a leaf spring having electrical conductivity and each include an earth cable connecting portion 61 arranged on the terminal holding portion 56*a* on the proximal end side of the case 45, a distal end portion 62 arranged on the supporting device 57 on the distal end side of the case 45, and the terminal strip portion 63 connected to the earth pins 28 between the earth cable connecting portion 61 and the distal end portions 62. The terminal strip portions 63 of the pair of terminals 42 are arranged along both sides of the earth pin insertion area 50 in the case 45.

The earth cable connecting portion 61 includes an insertion hole 64 which allows insertion of the earth cable inserted from the earth cable insertion hole 59, and a locking strip 65 electrically connected to the earth cable inserted into the insertion hole 64 and configured to prevent the earth cable from coming apart.

The distal end portions 62 are formed so as to be bent into a substantially L-shape outward of the earth pin insertion area 50 from distal ends of the terminal strip portions 63, and are supported by being inserted into the supporting grooves 58 of the supporting device 57.

Figure 2:
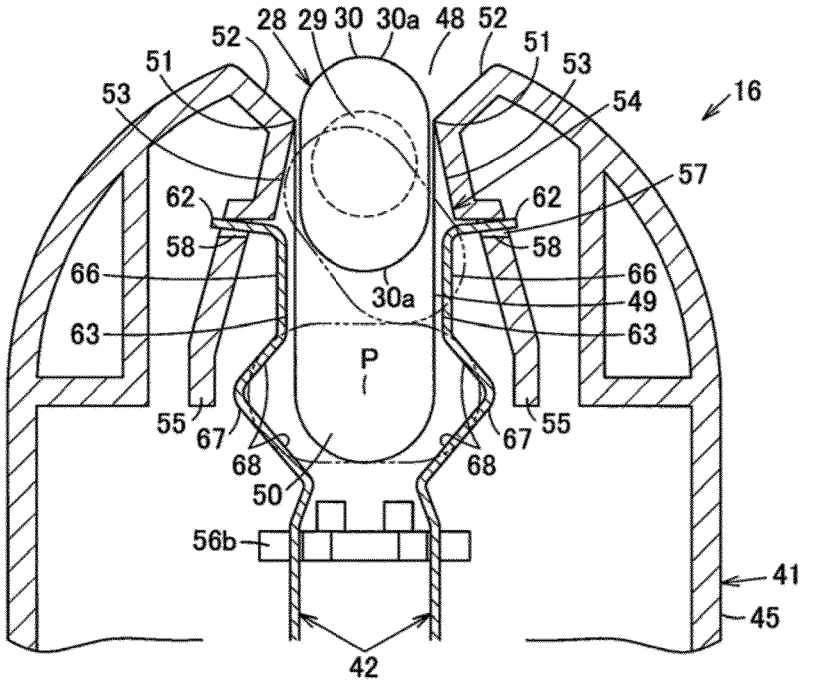
FIG. 2 is a cross-sectional view for explaining an earth pin mounting action of the same socket.

The terminal strip portions 63 are each formed with an earth pin introducing portion 66 arranged so as to extend along the earth pin insertion area 50 at the distal end side, and a fitting portion 67 configured to hold the earth pin 28 in the holding position P. The fitting portion 67 is formed into a substantially V-shaped depression in cross section composed of a pair of inclined surfaces 68 so that inner surfaces of the pair of terminals 42 facing each other are depressed, and as illustrated in FIG. 1 to FIG. 3, the pair of inclined surfaces 68 come into contact at two points with a peripheral surface of the holding portion 30 of the earth pin 28 rotated to the holding position P. In FIG. 1 to FIG. 3, the holding portion 30 of the earth pin 28 rotated to the holding position P is shown by a double dashed chain line. However, the terminals 42 are illustrated in an initial state before resiliently deformed by being pressed by the holding portion 30 of the earth pin 28. Outer surfaces of the fitting portions 67 face the restricting walls 55 of the case 45.

The socket 17 for power supply includes a socket body and a pair of power supply terminals arranged in the socket body. Then, the pair of lamp pins 31 of the straight tube type lamp 12 are inserted from a distal end surface of the socket body, and the straight tube type lamp 12 is rotated 90° about a tube axis thereof, so that the straight tube type lamp 12 is mounted with the pair of lamp pins 31 connected to the pair of power supply terminals respectively.

The lighting apparatus 18 illustrated in FIG. 7 is configured to receive a supply of commercial AC power source, convert an AC power to a DC power, and supply the DC power to the light source unit 22 through the pair of power supply terminals of the socket 17 for power supply side and the pair of lamp pins 31 of the straight tube type lamp 12.

Subsequently, when connecting the straight tube type lamp 12 in the luminaire 11 configured in this manner, as illustrated in FIG. 6, the earth pin 28 and the lamp pins 31 of the straight tube type lamp 12 are inserted from distal end surfaces of the sockets 16, 17 respectively to arrange the straight tube type lamp 12 between the sockets 16, 17, and the straight tube type lamp 12 is rotated 90° in the mounting direction about the tube axis thereof, so that the straight tube type lamp 12 can be mounted with the earth pin 28 of the straight tube type lamp 12 held in the socket 16 and the lamp pins 31 held in the socket 17, respectively and in an electrically connected state.

Then, by an operation of the lighting apparatus 18, the DC power from the lighting apparatus 18 is supplied to the light source unit 22 of the straight tube type lamp 12 through the socket 17 for power supply, so that the respective semiconductor light-emitting elements 25 of the light source unit 22 are illuminated and light from the respective semiconductor light-emitting elements 25 passes through the translucent cover 21 and irradiated to the predetermined direction of irradiation under the luminaire 11.

When demounting the straight tube type lamp 12, in contrast to the mounting procedure, the straight tube type lamp 12 is rotated 90° in the counter-mounting direction at the holding position P and the earth pin 28 and the lamp pins 31 of the straight tube type lamp 12 are pulled out from the distal end surfaces of the sockets 16, 17.

Subsequently, an action of the socket 16 on the earth side will be described.

The earth pin 28 of the straight tube type lamp 12 is inserted into the insertion port 48 in a state in which the longitudinal direction of the holding portion 30 faces the insertion port 48 on the distal end surface of the case 45 as shown by a solid line in FIG. 1. When the earth pin 28 is inserted to the holding position P of the socket 16, the holding portion 30 of the earth pin 28 is arranged between the fitting portions 67 of the pair of terminals 42.

In a state in which the earth pin 28 is inserted into the holding position P of the socket 16, the straight tube type lamp 12 is rotated by 90° about the tube axis thereof so that the direction of emission of light of the straight tube type lamp 12 is directed to the predetermined direction of irradiation. When the straight tube type lamp 12 is rotated, the holding portion 30 of the earth pin 28 rotates while resiliently deforming the pair of terminals 42 outward at both end portions of the holding portion 30 of the earth pin 28 in the longitudinal direction. As shown by a double-dashed chain line in FIG. 1, when the earth pin 28 rotates 90°, the both end portions of the holding portion 30 in the longitudinal direction are fitted and stopped in the fitting portions 67 of the pair of terminals 42. In this state, the respective inclined surfaces 68 of the fitting portions 67 of the pair of terminals 42 come into contact respectively with the holding portion 30, and the pair of terminals 42 hold the earth pin 28 in a state in which the pair of terminals 42 are in contact therewith at four points.

Since the straight tube type lamp 12 is long, if the straight tube type lamp 12 is rotated in the mounting direction in a state of incomplete insertion in which the earth pin 28 is not inserted to the holding position P of the socket 16 when mounting the straight tube type lamp 12 in the sockets 16, 17, the earth pin 28 cannot be mounted in the holding position P. However, this problem may be avoided with the socket 16 of this embodiment.

For example, as illustrating the position of the earth pin 28 with a solid line in FIG. 1, when the holding portion 30 rotates in a state in which a center portion of the holding portion 30 of the earth pin 28 is located in the insertion port 48 side of the narrow portions 51 of the socket 16, the holding portion 30 is allowed to rotate by the pair of insertion port-side inclined portions 52 increasing the distance therebetween toward the insertion port 48, and the rotating holding portion 30 rotates in a state of keeping in contact with one of the insertion port-side inclined portions 52, whereby the holding portion 30 moves toward the insertion port 48 so that the portion inserted between the narrow portions 51 moves out from between the narrow portions 51. In this manner, the earth pin 28 is ejected from the socket 16 to the insertion port 48, and is not mounted in the socket 16.

As illustrating the position of the earth pin 28 with a solid line in FIG. 2, when the holding portion 30 rotates in a state in which the center portion of the holding portion 30 of the earth pin 28 is located on a side opposite to the insertion port 48 with respect to the narrow portions 51 of the socket 16, the holding portion 30 is allowed to rotate by the pair of guiding inclined portions 53 increasing the distance therebetween toward the holding position P, and rotates with both ends of the rotating holding portion 30 in the direction of the long diameter in contact with the pair of guiding inclined portions 53, so that the holding portion 30 moves toward the holding position P.

In the course of movement of the holding portion 30 toward the holding position P, the holding portion 30 comes into contact with the earth pin introducing portions 66 of the pair of terminals 42, and the pair of terminals 42 are resiliently deformed toward the outside. The earth pin introducing portion 66 of the pair of terminals 42 being resiliently deformed to the outside is inclined so as to increase the distance therebetween toward the holding position P along the pair of restricting walls 55. In contrast, the outward resilient deformation of the earth pin introducing portions 66 of the pair of terminals 42 is restricted by abutment against the pair of restricting walls 55.

At this time, in order to support the distal end portions 62 of the terminals 42 with the supporting device 57 and allow the restricting walls 55 to increase the distance therebetween toward the holding position P and the earth pin introducing portions 66 of the terminals 42 to increase the distance therebetween toward the holding position P, the earth pin introducing portions 66 of the terminals 42 increase the distance therebetween toward the holding position P and function as parts of the guiding inclined portions 53.

Therefore, the holding portion 30 moves toward the holding position P by the rotation of the rotating holding portion 30 while keeping in contact with the earth pin introducing portions 66 of the terminals 42 increasing the distance therebetween toward the holding position P, and when the holding portion 30 further moves toward the holding position P subsequently, a stress applied on the resilient deformation of the pair of terminals 42 is generated in the direction of bringing the holding portion 30 to the holding position P, so that the holding portion 30 is automatically brought into the holding position P and is fitted between the fitting portions 67 of the pair of terminals 42. In this manner, the holding portion 30 of the earth pin 28 is brought to the holding position P in the socket 16 and is mounted in a state of reliably connected to the pair of terminals 42 at the holding position P in the socket 16.

In this manner, according to the socket 16 of this embodiment, when the earth pin 28 of the straight tube type lamp 12 is rotated in the vicinity of the insertion port 48 of the socket 16, the holding portion 30 of the earth pin 28 comes apart from the socket 16 by moving in the direction of leaving the insertion port 48 by the pair of insertion port-side inclined portions 52 increasing the distance therebetween toward the insertion port 48, so that being incapable of mounting the earth pin 28 at the holding position P or application of an excessive load on the straight tube type lamp 12 or the socket 16 may be prevented.

Since the minimum dimension between the pair of insertion port-side inclined portions 52 is set to be larger than the short diameter dimension of the holding portion 30 of the earth pin 28 and smaller than the long diameter dimension thereof, the pair of insertion port-side inclined portions 52 may be functioned reliably.

Also, when the earth pin 28 is rotated in the state of being located between the insertion port 48 and the holding position P, which is the incomplete state of insertion, the holding portion 30 of the earth pin 28 is introduced to the holding position P by the guiding device 54, and the earth pin 28 may be mounted in the holding position P.

Since the pair of guiding inclined portions 53 increasing the distance therebetween toward the holding position P are provided as the guiding device 54, the holding portion 30 of the earth pin 28 is brought to the holding position P by the pair of guiding inclined portions 53 and is reliably connected to the pair of terminals 42, so that the earth pin 28 may be mounted in the holding position P.

Since the guiding inclined portions 53 are integrally formed with the case 45 of the socket body 41, the number of components may be reduced, and hence productivity of the socket 16 may be improved.

The guiding inclined portions 53 may be formed separately from the case 45 of the socket body 41 and assembled to the socket body 41.

Referring now to the drawings, a second embodiment will be described with reference to FIG. 8. The same configuration as those of the embodiment described above will be denoted by the same reference numerals and the description thereof is omitted.

Described here is an example in which guiding inclined portions of the guiding device 54 configured to guide the holding portion 30 to the holding position P in association with the rotation of the earth pin 28 is constituted by parts of the terminals 42.

The case 45 is integrally formed with the pair of restricting walls 55 increasing the distance therebetween from the pair of narrow portions 51, which are the end side opposite to the insertion port 48 of the pair of insertion port-side inclined portions 52, toward the inner side opposite to the insertion port 48, which is the holding position P where the earth pin 28 is held.

The supporting device 57 is composed of the supporting grooves 58 formed between the insertion port-side inclined portions 52 and the restricting walls 55, and is configured to support the distal ends of the terminals 42 inserted into the supporting grooves 58.

The distal end portions 62 of the pair of terminals 42 are inserted into and supported by the supporting grooves 58 of the supporting device 57 and the earth pin introducing portions 66 and the fitting portions 67 of the terminal strip portions 63 are arranged inside the restricting walls 55, and the earth pin introducing portions 66 are arranged along the both sides of the earth pin insertion area 50 in the case 45.

Figure 8:
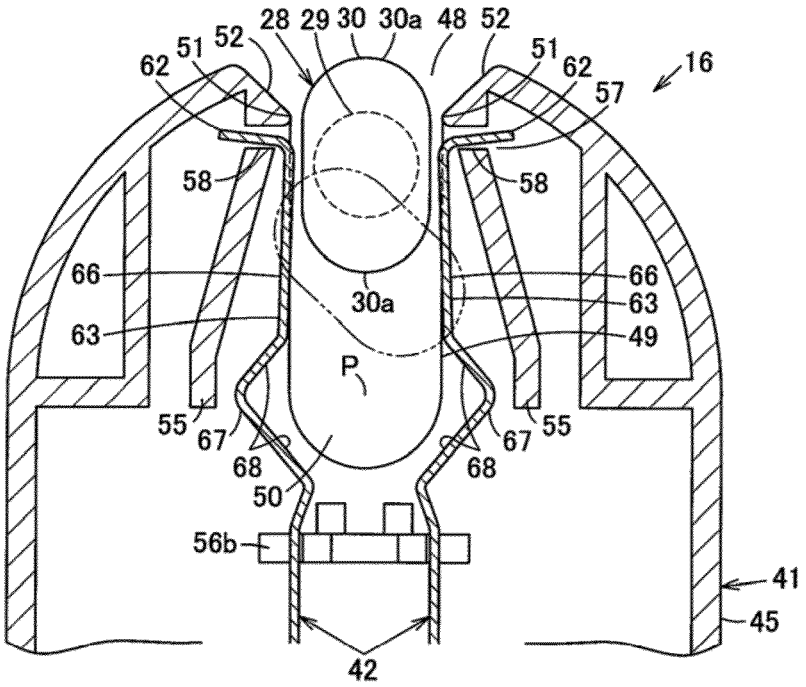
FIG. 8 is a cross-sectional view for explaining an earth pin mounting action of a socket according to a second embodiment.

Then, as illustrating the position of the earth pin 28 with a solid line in FIG. 8, when the holding portion 30 rotates in the state in which the center portion of the holding portion 30 of the earth pin 28 is located on the side opposite to the insertion port 48 with respect to the narrow portions 51 of the socket 16, both ends of the holding portion 30 in the long diameter direction come into contact with the earth pin introducing portions 66 of the pair of terminals 42 and the earth pin introducing portions 66 of the pair of terminals 42 are resiliently deformed outward. The earth pin introducing portions 66 of the pair of terminals 42 being resiliently deformed to the outside are inclined so as to increase the distance therebetween toward the holding position P along the pair of restricting walls 55. In contrast, the outward resilient deformation of the earth pin introducing portions 66 of the pair of terminals 42 is restricted by abutment against the pair of restricting walls 55.

At this time, since the distal end portions 62 of the terminals 42 are supported by the supporting device 57 and the restricting walls 55 are increased the distance therebetween toward the holding position P to allow the earth pin introducing portions 66 of the terminals 42 to increase the distance therebetween toward the holding position P, the earth pin introducing portions 66 of the terminals 42 increase the distance therebetween toward the holding position P and function as the guiding inclined portions.

Therefore, the holding portion 30 moves toward the holding position P by the rotation of the rotating holding portion 30 while keeping in contact with the earth pin introducing portions 66 of the terminals 42 increasing the distance therebetween toward the holding position P, and when the holding portion 30 further moves toward the holding position P subsequently, a stress applied on the resilient deformation of the pair of terminals 42 is generated in the direction of bringing the holding portion 30 to the holding position P, so that the holding portion 30 is automatically brought into the holding position P and is fitted between the fitting portions 67 of the pair of terminals 42. In this manner, the holding portion 30 of the earth pin 28 is brought to the holding position P in the socket 16 and is mounted in the state of reliably connected to the pair of terminals 42 at the holding position P in the socket 16.

In this manner, according to the socket 16 of the second embodiment, by the provision of the terminals 42 and the supporting device 57 as the guiding device 54 configured to guide the holding portion 30 of the earth pin 28 toward the holding position P, the stress generated when the holding portion 30 of the earth pin 28 resiliently deforms the terminals 42 may be directed toward the holding position P, and hence the holding portion 30 of the earth pin 28 is brought to the holding position P by the pair of guiding inclined portions 53 and is connected reliably to the pair of terminals 42, and the earth pin 28 may be mounted in the holding position P.

Referring now to the drawings, a third embodiment will be described with reference to FIG. 9. The same configuration as those of the embodiment described above will be denoted by the same reference numerals and the description thereof is omitted.

Described in the configuration of the second embodiment illustrated in FIG. 8 is an example in which the supporting device 57 is provided with a stopper portion 71 configured to restrict the distal end portions 62 of the terminals 42 from moving outward.

Figure 9:
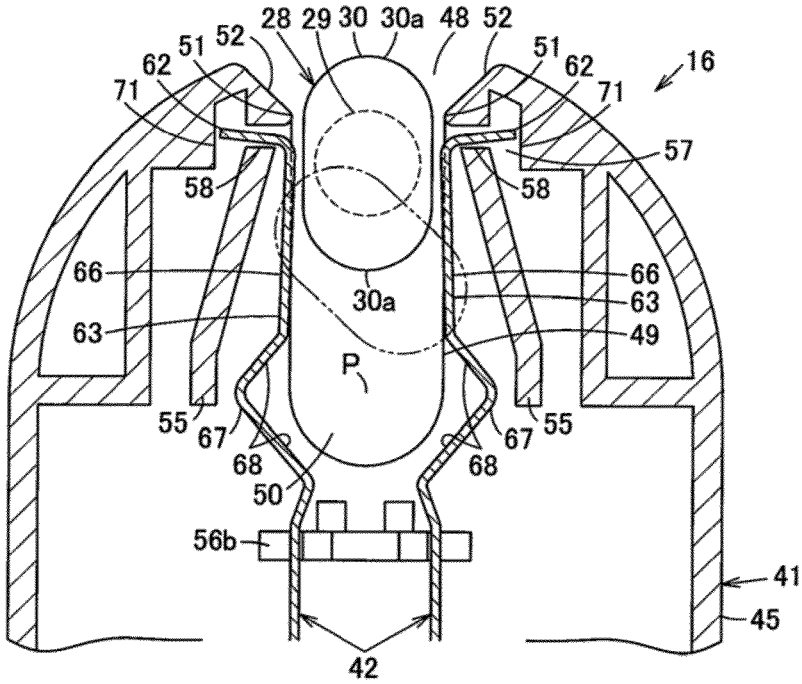
FIG. 9 is a cross-sectional view for explaining an earth pin mounting action of a socket according to a third embodiment.

Then, as illustrating the position of the earth pin 28 with a solid line in FIG. 9, when the holding portion 30 rotates in the state in which the center portion of the holding portion 30 of the earth pin 28 is located on a side opposite to the insertion port 48 with respect to the narrow portions 51 of the socket 16, both ends of the holding portion 30 in the long diameter direction come into contact with the earth pin introducing portions 66 of the pair of terminals 42 and the earth pin introducing portions 66 of the pair of terminals 42 are resiliently deformed outward. The earth pin introducing portions 66 of the pair of terminals 42 being resiliently deformed to the outside are inclined so as to increase the distance therebetween toward the holding position P along the pair of restricting walls 55.

At this time, since the distal end portions 62 of the terminals 42 are prevented from moving outward by the distal end portions 62 of the terminals 42 abutting against the stopper portion 71 of the supporting device 57, the earth pin introducing portions 66 of the terminals 42 are inclined so as to increase the distance therebetween toward the holding position P, and are functioned reliably as the guiding inclined portions, whereby the stress against the resilient deformation of the pair of terminals 42 may be reliably generated in the direction of bringing the holding portion 30 to the holding position P.

Referring now to the drawings, a fourth embodiment will be described with reference to FIG. 10. The same configuration as those of the embodiment described above will be denoted by the same reference numerals and the description thereof is omitted.

Described below is an example in which the restricting walls 55 are omitted from the configuration of the second embodiment illustrated in FIG. 8, and is an example in which the guiding inclined portion of the guiding device 54 is composed only of the terminals 42.

By eliminating the restricting walls 55, a space portion 74 which prevents the fitting portions 67 from coming into contact with the socket body 41 or the like even when the fitting portions 67 of the terminals 42 are deformed so as to move the outermost positions by the holding portion 30 of the earth pin 28 is formed in the outward direction in which the fitting portions 67 of the terminals 42 are deformed by the holding portion 30 of the earth pin 28.

Figure 10:
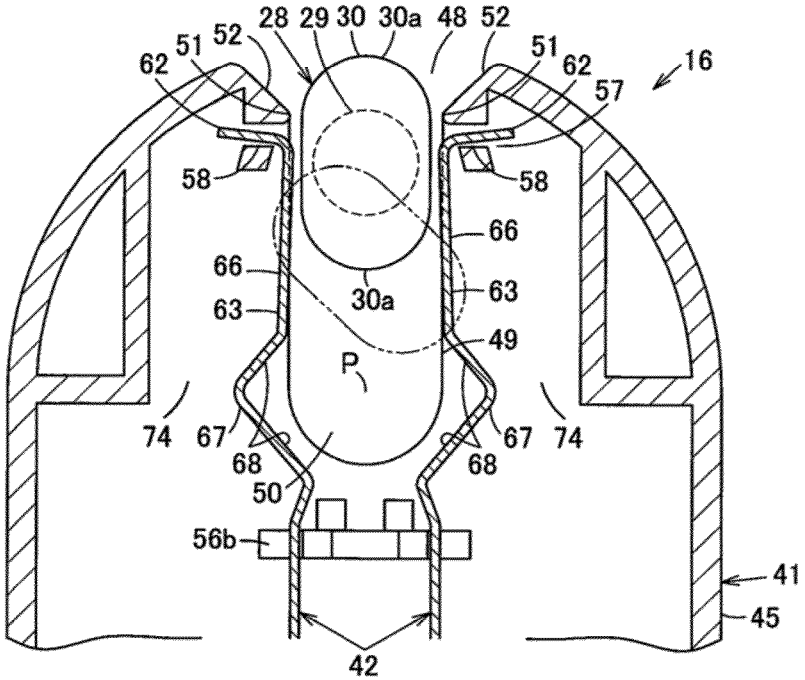
FIG. 10 is a cross-sectional view for explaining an earth pin mounting action of a socket according to a fourth embodiment.

In this case as well, as illustrating the position of the earth pin 28 with a solid line in FIG. 10, when the holding portion 30 rotates in the state in which the center portion of the holding portion 30 of the earth pin 28 is located on the side opposite to the insertion port 48 with respect to the narrow portions 51 of the socket 16, the both ends of the holding portion 30 in the long diameter direction come into contact with the earth pin introducing portions 66 of the pair of terminals 42 and the earth pin introducing portions 66 of the pair of terminals 42 are resiliently deformed outward.

At this time, since the supporting device 57 supports the distal end portions 62 of the terminals 42, and the earth pin introducing portions 66 of the terminals 42 can increase the distance therebetween toward the holding position P, and also the fitting portions 67 located on the side where the earth pin introducing portions 66 increase the distance therebetween move into the space portion 74 so as not to restrict the increase of the distance between the earth pin introducing portions 66, the earth pin introducing portions 66 of the terminals 42 reliably increase the distance therebetween toward the holding position P, and function as the guiding inclined portion.

Therefore, the holding portion 30 moves toward the holding position P by the rotation of the rotating holding portion 30 while keeping in contact with the earth pin introducing portions 66 of the terminals 42 increasing the distance therebetween toward the holding position P, and when the holding portion 30 further moves toward the holding position P subsequently, a stress applied on the resilient deformation of the pair of terminals 42 is generated in the direction of bringing the holding portion 30 to the holding position P, so that the holding portion 30 is automatically brought into the holding position P and is fitted between the fitting portions 67 of the pair of terminals 42. In this manner, the holding portion 30 of the earth pin 28 is brought to the holding position P in the socket 16 and is mounted in the state of reliably connected to the pair of terminals 42 at the holding position P in the socket 16.

In the second to the fourth embodiments, the function of the pair of insertion port-side inclined portions 52 is the same as that in the first embodiment.

The socket on the earth side only has to have at least a pair of inclined portions, and may be of any configuration including the case where the guiding inclined portions are not provided as long as the holding portion may be guided to the predetermined holding position in association with the rotation of the earth pin in addition to the configurations illustrated in the second to the fourth embodiments if provided.

Subsequently, a fifth embodiment will be described with reference to FIG. 11 to FIG. 15. The same configuration as those of the embodiment described above will be denoted by the same reference numerals and the description thereof is omitted.

As illustrated in FIG. 11 to FIG. 14, the notched portion 49 of the case 45 is formed with an earth pin mounting opening 101 corresponding to the holding position P, and is formed with abutting portions 102 between the insertion port 48 side and the earth pin mounting opening 101.

The abutting portions 102 have a distance therebetween smaller than the diameter of the leg portion 29 of the earth pin 28, and are configured to apply resistance against the movement of the leg portion 29 of the earth pin 28 at a position between the insertion port 48 and the earth pin mounting opening 101. The abutting portions 102 are formed with a chevron shape projecting inward of the notched portion 49, and the case 45 is formed on the front surface thereof with slits 103 on the outside positions of the abutting portions 102. When the leg portion 29 of the earth pin 28 passes between the abutting portions 102, the abutting portions 102 resiliently deform outward of the notched portion 49, and allow the leg portion 29 of the earth pin 28 to pass through the abutting portions 102.

The case 45 is formed with restricting walls 104 on both sides of insides of the insertion port 48. An opposed distance e of the restricting walls 104 on both sides is larger than the short diameter dimension b of the holding portion 30 of the earth pin 28 in the short direction, and smaller than the long diameter dimension c of the holding portion 30 in the longitudinal direction. The case 45 is further formed with wall portions 105 respectively on the outsides of the both restricting walls 104.

A plurality of locking portions 107 to be locked by the case 45 in a state of closing the back surface of the case 45 are formed on the front surface of the cover 46, and a plurality of holding projections 108 positioning and holding the respective terminals 42 with respect to the case 45 are formed so as to project therefrom.

The terminal strip portions 63 of the pair of terminals are each formed with a restricting strip portion 110 projecting outward from between the distal end portions 62 and the fitting portions 67. The restricting strip portions 110 are configured to abut against the wall portions 105 of the case 45 when the terminal strip portions 63 are resiliently deformed outward more than a predetermined portion and suppress the resilient deformation.

Figure 11:
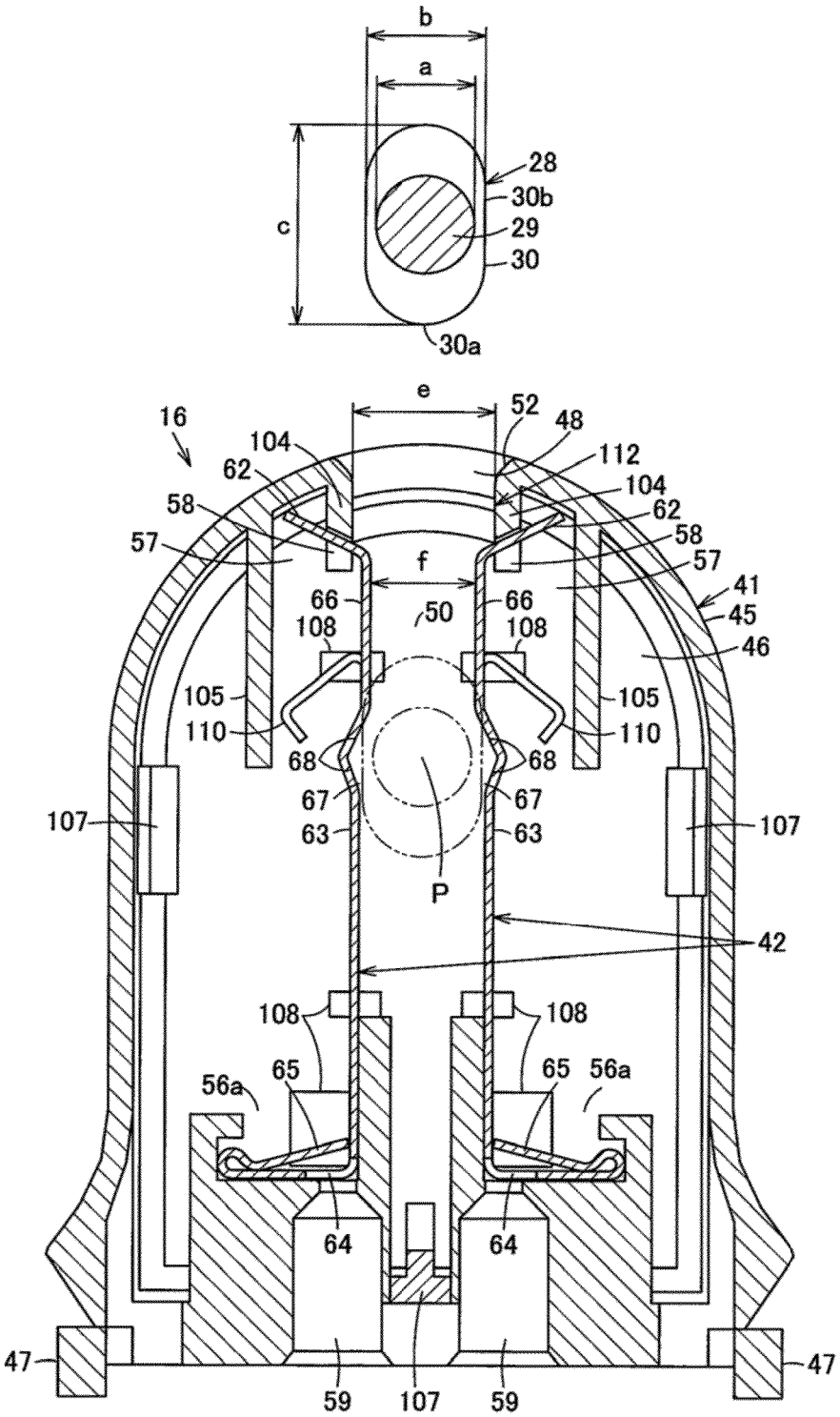
FIG. 11 is a cross-sectional view of a socket according to a fifth embodiment.

As illustrated in FIG. 11, an opposed distance f between the earth pin introducing portions 66 of the pair of terminals 42 is set to a dimension smaller than the short diameter dimension b of the holding portion 30 of the earth pin 28 in the short side direction. The outward resilient deformation of the earth pin introducing portions 66 of the pair of terminals 42 allows passage of the holding portion 30 of the earth pin 28 therebetween.

Then, a rotation restricting portion 112 configured to allow the rotation of the earth pin 28 whose leg portion 29 is inserted into the earth pin mounting opening 101 (the holding position P) by the restricting walls 104 located on the both sides of the insertion port 48 of the case 45 and the distal end portions 62 of the pair of terminals 42, and restrict the rotation of the earth pin 28 in a state of being located before the insertion of the leg portion 29 into the earth pin mounting opening 101 (the holding position P).

Figure 15:
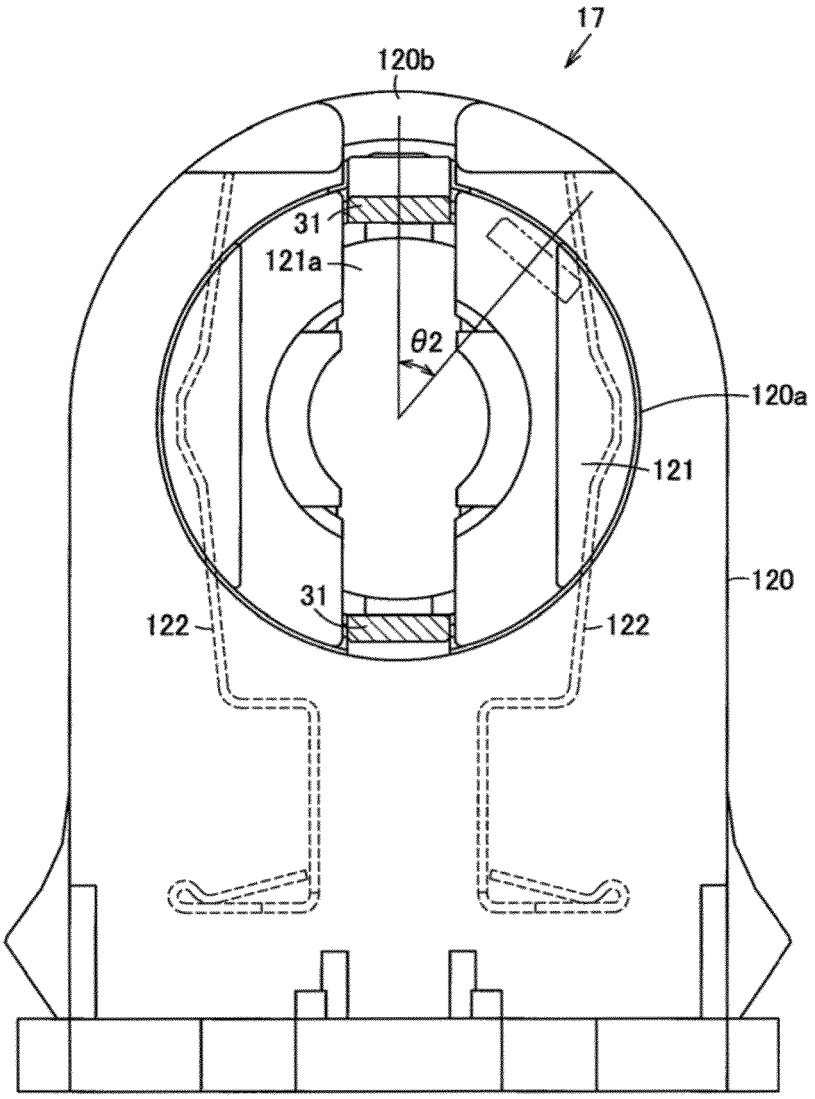
FIG. 15 is a front view of the same socket for feeding power.

As illustrated in FIG. 15, the socket 17 for power supply includes a socket body 120, a rotating member 121 arranged in the socket body 120 so as to be rotatable, and a pair of power supply terminals 122 arranged in the socket body 120.

The socket body 120 is formed with a circular opening portion **120*a* having the rotating member 121 rotatably arranged on the front surface thereof, and an insertion groove 120*b* communicating with the opening portion 120*a* on the front surface from a distal end surface thereof and allowing the pair of lamp pins 31 to be inserted therein. The rotating member 121 is also formed with an insertion groove 121*a* which allows insertion of the pair of lamp pins 31**.

Then, the pair of lamp pins 31 of the straight tube type lamp 12 are inserted into the insertion groove **120*b* and the insertion groove 121*a* of the rotating member 121 from the distal end surface of the socket body 120, and the straight tube type lamp 12 is rotated 90° about the tube axis thereof, whereby the pair of lamp pins 31 come into contact respectively with the pair of power supply terminals 122 in the course of the rotation thereof and resiliently deform the pair of power supply terminals 122** outward and are mounted at a predetermined mounting position.

Subsequently, when connecting the straight tube type lamp 12, as illustrated in FIG. 6, the earth pin 28 and the lamp pins 31 of the straight tube type lamp 12 are inserted from the distal end surfaces of the sockets 16, 17 respectively to arrange the straight tube type lamp 12 between the sockets 16, 17, and the straight tube type lamp 12 is rotated 90° about the tube axis thereof, so that the straight tube type lamp 12 can be mounted between the sockets 16, 17.

As illustrated in FIG. 11, the earth pin 28 of the straight tube type lamp 12 is inserted into the insertion port 48 in a state in which the longitudinal direction of the holding portion 30 faces the insertion port 48 of the case 45.

When the holding portion 30 of the earth pin 28 is inserted into the insertion port 48 of the case 45, the holding portion 30 of the earth pin 28 firstly comes into contact with the pair of terminals 42, so that an earth connection is immediately established. At this time, in the socket 17 for power supply, the lamp pins 31 do not come into contact with the power supply terminals 122 only by the insertion of the lamp pins 31 for the power supply of the straight tube type lamp 12 into the socket 17 for the power supply.

When the holding portion 30 of the earth pin 28 is inserted further into the insertion port 48, the holding portion 30 of the earth pin 28 is inserted between the pair of terminals 42 while resiliently deforming the pair of terminals 42 outward.

In this case as well, the portion of the earth pin introducing portions 66 of the terminals 42 function as the guiding inclined portions of the guiding device 54 as described above.

When the holding portion 30 of the earth pin 28 is inserted further into the insertion port 48, the leg portion 29 of the earth pin 28 abuts against the pair of abutting portions 102 of the case 45, and resistance is applied to the insertion of the earth pin 28. When the insertion of the earth pin 28 is further continued against the resistance, the leg portion 29 of the earth pin 28 is fitted to the earth pin mounting opening 101 of the case 45 beyond the pair of abutting portions 102 of the case 45 while resiliently deforming the pair of abutting portions 102 of the case 45 outward. When the leg portion 29 of the earth pin 28 is fitted to the earth pin mounting opening 101, insertion of the earth pin 28 is restricted and the position of insertion is fixed, and the pair of abutting portions 102 abut against the leg portion 29 of the earth pin 28 on the side opposite to the direction of insertion, so that the leg portion 29 of the earth pin 28 is held in a state of being fitted to the earth pin mounting opening 101 of the case 45. Therefore, an operator can easily know the fact that the earth pin 28 of the straight tube type lamp 12 is inserted to a predetermined position of the socket 16, and displacement or coming off of the earth pin 28 of the straight tube type lamp 12 from the predetermined position of insertion of the socket 16 is prevented.

When the earth pin 28 of the straight tube type lamp 12 is inserted to the predetermined position of insertion of the socket 16, the earth pin 28 is arranged between the fitting portions 67 of the pair of terminals 42 as shown by a double-dashed chain line in FIG. 11.

In contrast, as illustrated in FIG. 15, when the earth pin 28 of the straight tube type lamp 12 is inserted into the socket 16 on the earth side, the pair of lamp pins 31 of the straight tube type lamp 12 are inserted into the socket 17 on the power supply side simultaneously. The pair of lamp pins 31 are arranged on the rotating member 121, but are not connected to the pair of power supply terminals 122 yet.

Then, the straight tube type lamp 12 is rotated by 90° about the tube axis thereof until the mounting position so that the direction of emission of light of the straight tube type lamp 12 is directed to the predetermined direction of irradiation.

Figure 12:
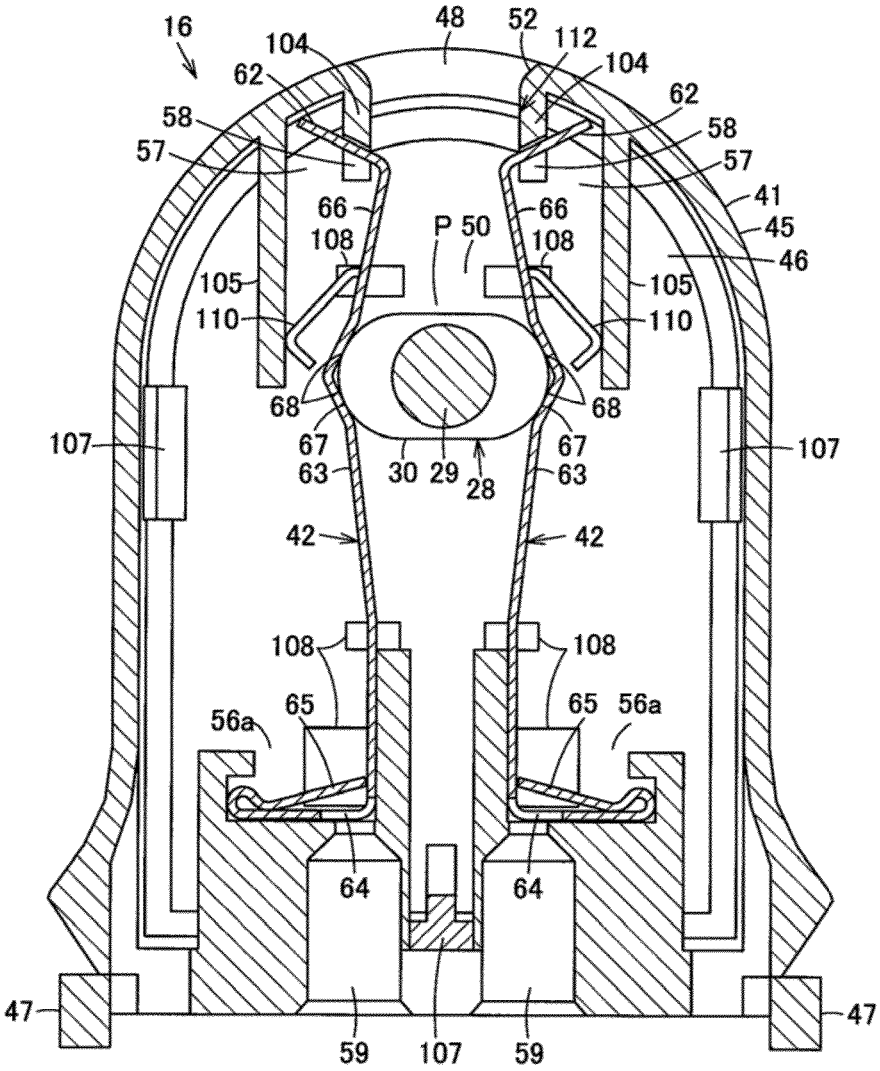
FIG. 12 is a cross-sectional view illustrating a lamp pin mounted state of the same socket.
Figure 13:
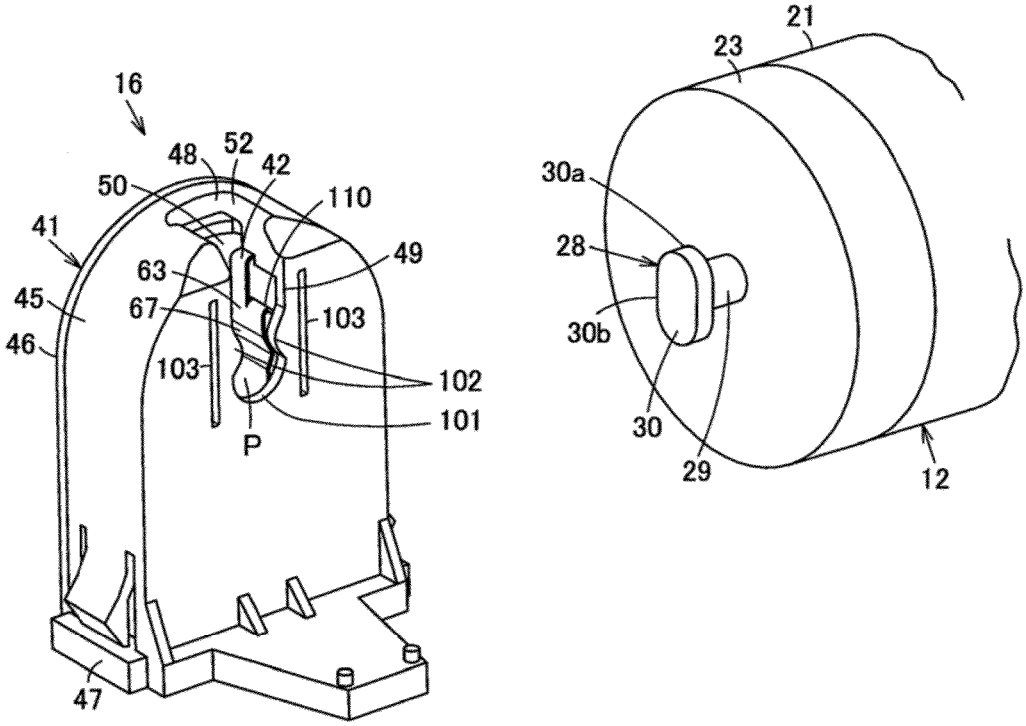
FIG. 13 is a perspective view illustrating parts of the same socket and a straight tube type lamp.
Figure 14:
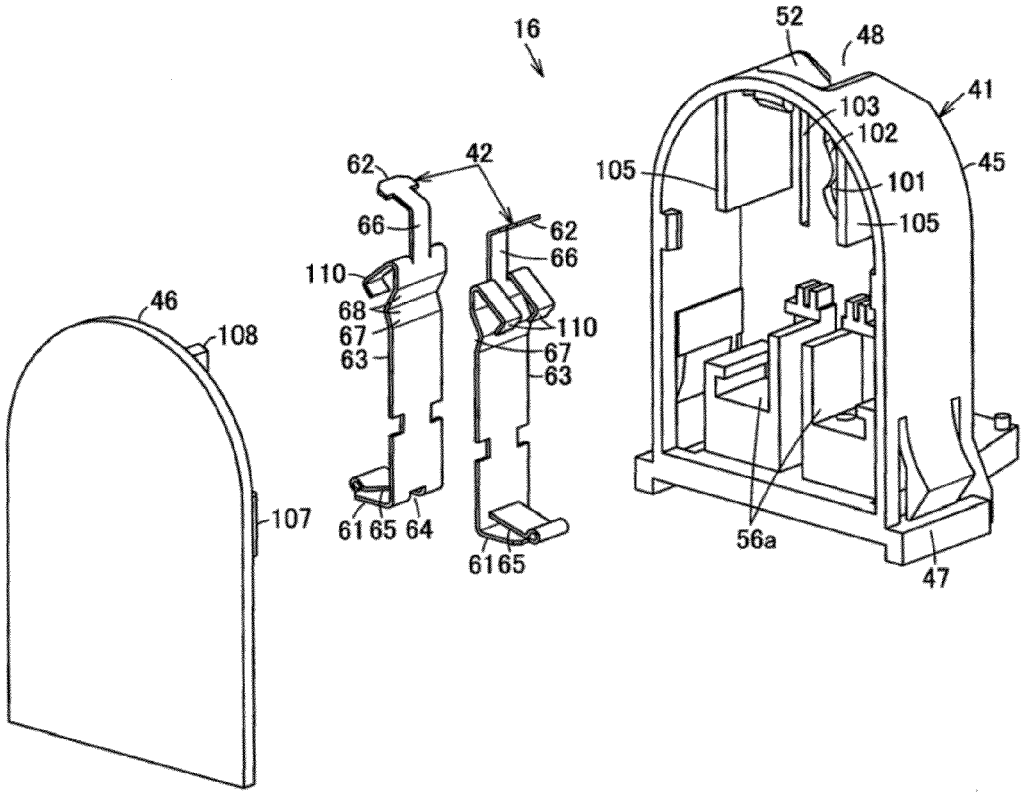
FIG. 14 is a perspective view of the same socket in a disassembled state.

When the straight tube type lamp 12 is rotated, the holding portion 30 of the earth pin 28 rotates while resiliently deforming the terminals 42 on both sides outward at both end portions of the holding portion 30 of the earth pin 28 in the longitudinal direction. As illustrated in FIG. 12, when the earth pin 28 rotates 90°, the both end portions of the holding portion 30 in the longitudinal direction are fitted and stopped in the fitting portions 67 of the terminals 42 on the both sides.

In a state in which the both end portions of the holding portion 30 in the longitudinal direction are fitted to the fitting portions 67 of the terminals 42 on the both sides, the respective inclined surfaces 68 of the fitting portions 67 of the terminals 42 on the both sides come into contact respectively with the holding portion 30, and the terminals 42 on the both sides hold the earth pin 28 in a state of being in contact at four points. At this time, since the restricting strip portions 110 abut against the wall portions 105 of the case 45, and restrict the terminals 42 on the both sides from moving outward, the holding portion 30 of the earth pin 28 is restricted from coming off the fitting portions 67, and the earth pin 28 is reliably prevented from dropping off the socket 16.

In contrast, in FIG. 15, when the straight tube type lamp 12 is rotated, the pair of lamp pins 31 rotate together with the rotating member 121 and come into contact with the pair of power supply terminals 122, whereby the pair of lamp pins 31 are held in the socket 17 in the mounting position rotated by 90°.

Then, by the operation of the lighting apparatus 18, the DC power from the lighting apparatus 18 is supplied to the light-source unit 22 through the pair of power supply terminals 122 of the socket 17 for power supply and the pair of lamp pins 31 of the straight tube type lamp 12, so that the respective semiconductor light-emitting elements 25 of the light-source unit 22 are illuminated and light from the respective semiconductor light-emitting elements 25 passes through the translucent cover 21 and is irradiated to the predetermined direction of irradiation under the luminaire 11.

When demounting the straight tube type lamp 12, the straight tube type lamp 12 is rotated 90° from the mounting position to the position of insertion. Accordingly, in the socket 16 for the earth, the longitudinal direction of the holding portion 30 of the earth pin 28 faces the direction of insertion with respect to the socket 17, so that the earth pin 28 can be pulled out and demounted from the insertion port 48 of the socket 17. In contrast, in the socket 17 for power supply, the direction of arrangement of the pair of lamp pins 31 faces the direction of insertion of the socket 16, and the pair of lamp pins 31 can be pulled out from the insertion groove **120*b* of the socket 17**.

When the straight tube type lamp 12 is rotated 90° from the mounting position to the position of insertion for demounting the straight tube type lamp 12, contact between the pair of lamp pins 31 and the pair of power supply terminals 122 is released in a state in which the contact between the earth pin 28 and the terminals 42 is maintained. Subsequently, when the straight tube type lamp 12 is pulled out from the sockets 16, 17, the contact between the earth pin 28 and the terminals 42 is released.

In this manner, in the case of mounting and demounting the straight tube type lamp 12, the pair of lamp pins 31 and the pair of power supply terminals 122 can be brought into and out of contact with each other in a state of being connected to the earth.

According to the socket 16 for the earth, since the rotation of the earth pin 28 at a position where the leg portion 29 is just before being inserted into the earth pin mounting opening 101 (the holding position P) of the socket body 41 is restricted by the rotation restricting portion 112, mounting of the earth pin 28 in a state in which the leg portion 29 of the earth pin 28 is not reliably inserted into the earth pin mounting opening 101 (the holding position P) of the socket body 41 or in a state of being inserted obliquely is prevented. In addition, by enabling the rotation of the earth pin 28 in the correct position of insertion in which the leg portion 29 of the earth pin 28 is inserted into the earth pin mounting opening 101 of the socket body 41, the connection between the earth pin 28 and the terminals 42 is ensured, and the earth pin 28 is prevented from dropping off the socket body 41.

Since the notched portion 49 of the socket body 41 is provided with the abutting portions 102 having a distance smaller than the diameter of the leg portion 29 of the earth pin 28 and providing resistance against the movement of the leg portion 29 of the earth pin 28 with respect to the earth pin mounting opening 101 (the holding position P), the operator can easily know the fact that the earth pin 28 is inserted to the predetermined position of insertion of the socket 16 when inserting the earth pin 28 into the socket 16, and the earth pin 28 can be held at the predetermined position of insertion. Also, the earth pin 28 may be prevented from being displaced or coming off from the predetermined position of insertion of the socket 16.

Figure 16:
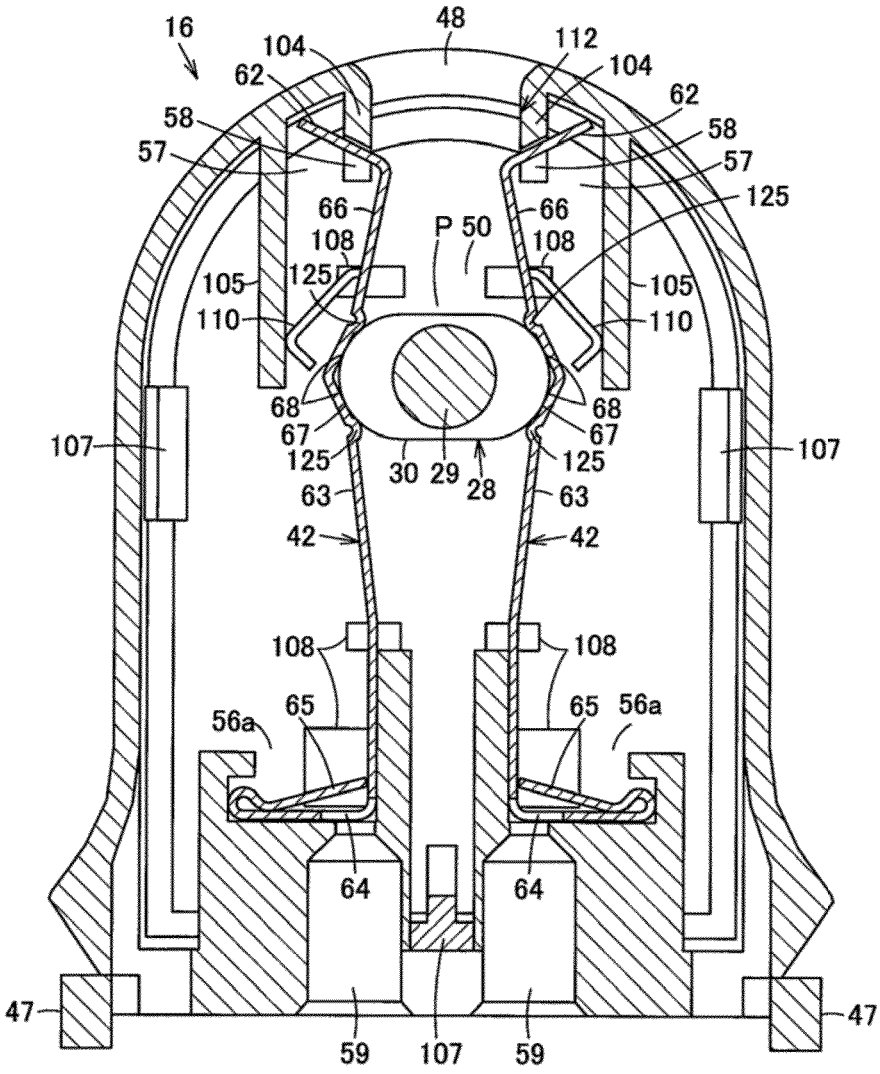
FIG. 16 is a cross-sectional view of a socket for an earth according to a sixth embodiment.

Subsequently, a sixth embodiment will be described with reference to FIG. 16. The same configuration as those of the embodiment described above will be denoted by the same reference numerals and the description thereof is omitted.

The each of the terminals 42 is provided with dowel-shaped projections 125 at both end positions of the fitting portions 67, that is, both end positions corresponding to the direction of rotation of the holding portion 30 of the earth pin 28 so as to project therefrom, respectively.

When rotating the holding portion 30 of the earth pin 28 inserted between the fitting portions 67 of the pair of terminals 42, the both end portions of the holding portion 30 of the earth pin 28 in the longitudinal direction each abut against one of the projections 125 of each of the terminals 42 and advance beyond the one of the projections 125 of each of the terminals 42, so that the both end portions of the holding portion 30 in the longitudinal direction are fitted to the fitting portions 67 of the respective terminals 42. Therefore, the operator can easily know the fact that the earth pin 28 is rotated to the predetermined mounting position by providing a tactile feedback to the position of rotation of the earth pin 28. Also, the other one of the projections 125 of each of the terminals 42 is capable of preventing the both end portions of the holding portion 30 in the longitudinal direction advanced beyond the one of the projections 125 from rotating excessively and coming apart from the fitting portions 67 of the respective terminals 42.

Figure 17:
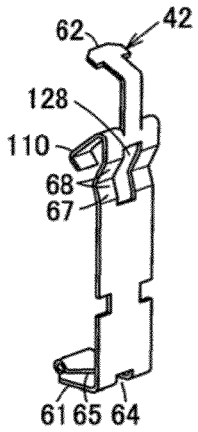
FIG. 17 is a perspective view of a terminal of a socket for an earth according to a seventh embodiment.
Figure 18:
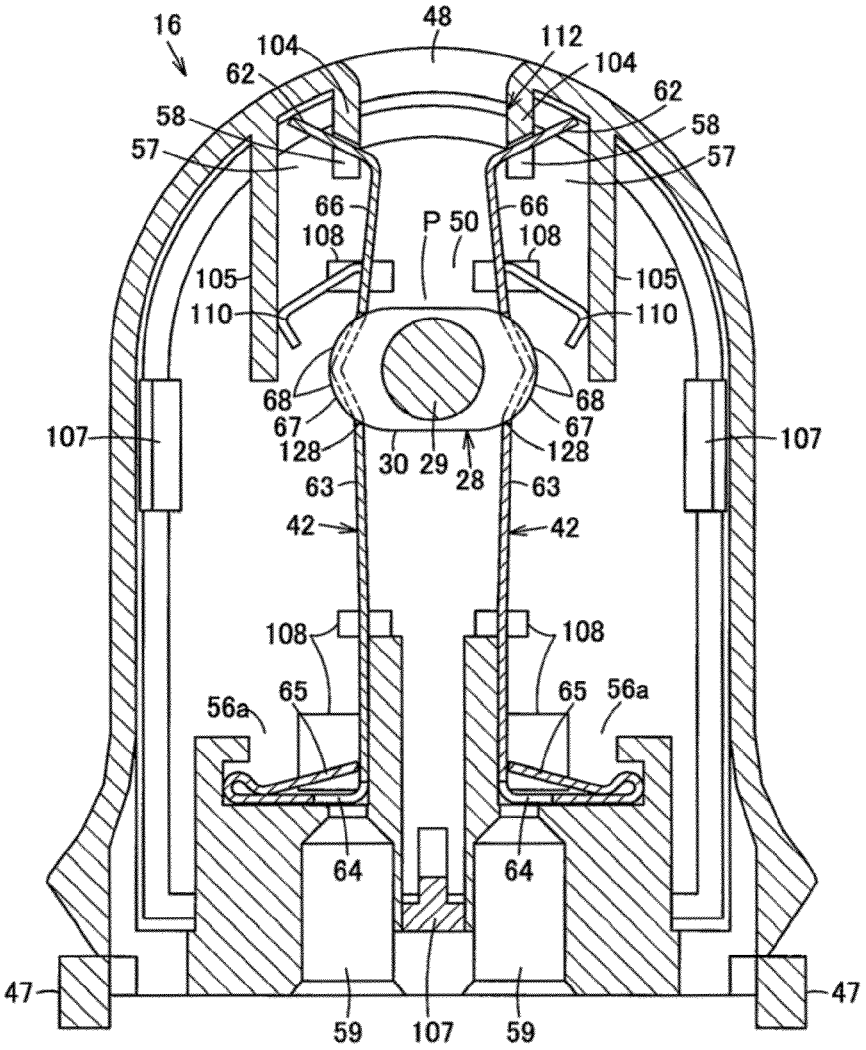
FIG. 18 is a cross-sectional view of the socket for the same earth.

A seventh embodiment will be described with reference to FIG. 17 and FIG. 18. The same configuration as those of the embodiment described above will be denoted by the same reference numerals and the description thereof is omitted.

The fitting portions 67 of the terminal strip portions 63 of the pair of terminals 42 are provided with fitting openings 128 to which the holding portion 30 of the earth pin 28 rotating to the mounting position is fitted.

When rotating the holding portion 30 of the earth pin 28 inserted between the fitting portions 67 of the pair of terminals 42, the both end portions of the holding portion 30 of the earth pin 28 in the longitudinal direction are fitted to the fitting openings 128. Therefore, the operator can easily know the fact that the earth pin 28 is rotated to the predetermined mounting position by providing the tactile feedback to the position of rotation of the earth pin 28. Also, in the state in which the both end portions of the holding portion 30 in the longitudinal direction are fitted to the fitting openings 128, edge portions of the distal end side and the proximal end side of the fitting openings 128 of the terminals 42 on the both sides come into contact with the holding portion 30 respectively, and the terminals 42 on the both sides hold the earth pin 28 in a state of contact at four points. Therefore, the earth pin 28 can be held reliably by the four-point supporting by the terminals 42 on the both sides, and the earth pin 28 is reliably prevented from coming off the terminals 42 or dropping off the socket 16.

An eighth embodiment will be described with reference to FIG. 19. The same configuration as those of the embodiment described above will be denoted by the same reference numerals and the description thereof is omitted.

The pair of terminals 42 are arranged on both sides of the insertion port 48 in the case 45 at positions in which the holding portion 30 of the earth pin 28 to be inserted into the insertion port 48 do not come into contact with the terminals 42. In other words, the pair of terminals 42 do not come into contact with the earth pin 28 only by inserting the earth pin 28 into the insertion port 48 of the socket body 41, and come into contact therewith by inserting the earth pin 28 into the holding position P of the socket body 41 and rotating therein.

The fitting portions 67 of the pair of terminals 42 are arranged on both sides of the holding portion 30 of the earth pin 28 inserted into the socket body 41 in the holding position P at positions facing each other.

Figure 19:
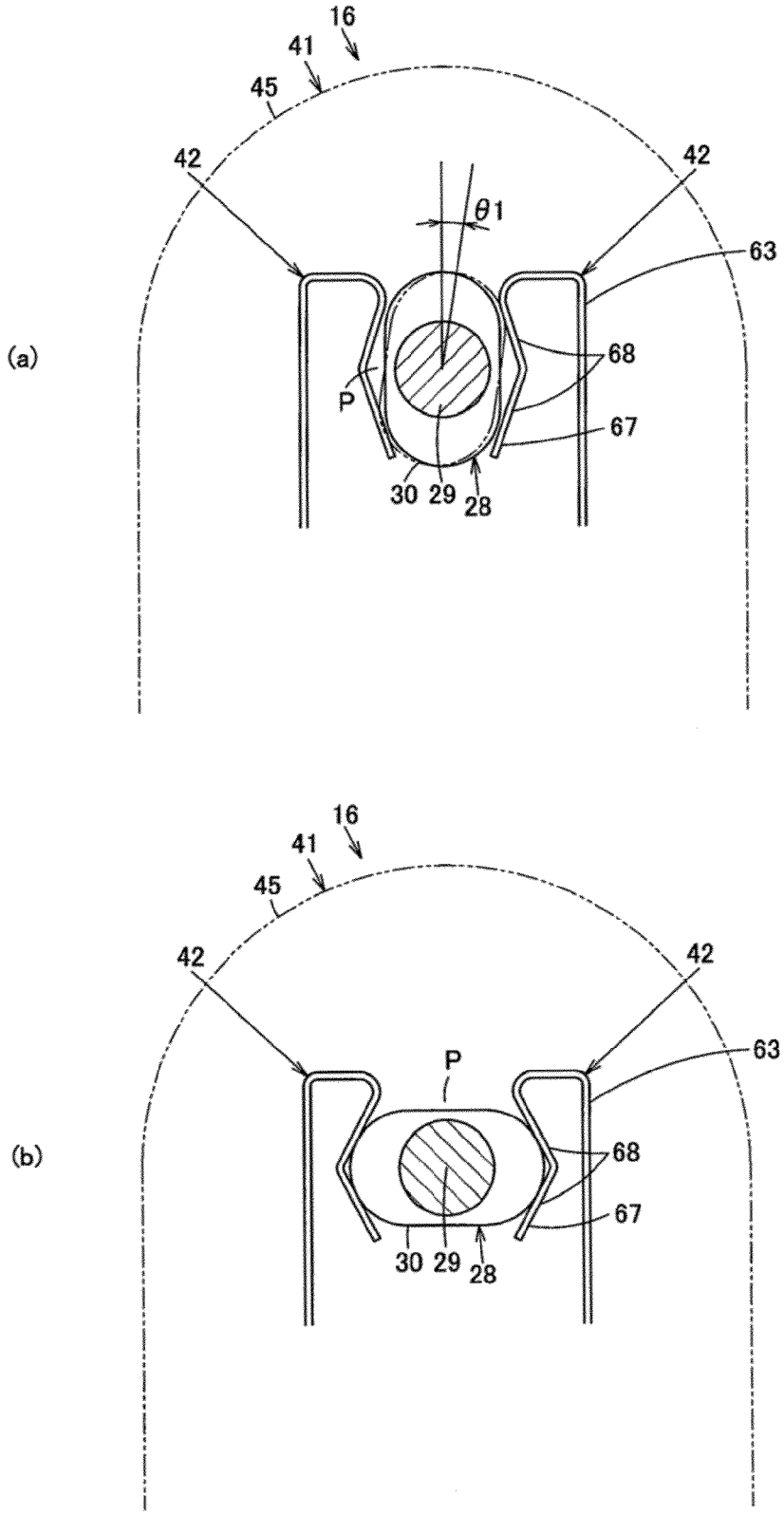
FIG. 19 illustrates a socket for an earth according to an eighth embodiment, in which (a) is a cross-sectional view illustrating a state in which an earth pin is inserted, and (b) is a cross-sectional view illustrating a state in which the inserted earth pin is rotated.

Then, as illustrated in FIG. 19(*a*), in a state in which the earth pin 28 is inserted into the predetermined position of insertion of the socket body 41 when mounting the straight tube type lamp 12, the holding portion 30 of the earth pin 28 is not in contact with the pair of terminals 42. In contrast, in a state in which the pair of lamp pins 31 for power supply is inserted into the socket 17 as illustrated in FIG. 15, the pair of lamp pins 31 are not in contact with the pair of power supply terminals 122.

As illustrated in FIG. 19(*b*), the holding portion 30 of the earth pin 28 comes into contact with the pair of terminals 42 by rotating the straight tube type lamp 12, while the pair of lamp pins 31 come into contact with the pair of power supply terminals 122. At this time, an angle of rotation $\theta 1$ required for the holding portion 30 of the earth pin 28 to come into contact with the pair of terminals 42 is smaller than an angle of rotation $\theta 2$ required for the pair of lamp pins 31 to come into contact with the pair of power supply terminals 122, and a relationship $\theta 1 < \theta 2$ is established.

Therefore, when the straight tube type lamp 12 is rotated, the earth pin 28 and the terminals 42 come into contact with each other first to achieve the earth connection and, subsequently, the pair of lamp pins 31 come into contact with the pair of power supply terminals 122 to allow power supply.

When the straight tube type lamp 12 mounted between the sockets 16, 17 is rotated for demounting therefrom, first of all, the contact of the pair of lamp pins 31 with respect to the pair of power supply terminals 122 is released and, subsequently, the contact between the earth pin 28 and the terminals 42 is released.

In this manner, in the case of mounting and demounting the straight tube type lamp 12, the pair of lamp pins 31 and the pair of power supply terminals 122 can be brought into and out of contact with each other in a state of being connected to the earth.

In the eighth embodiment as well, the socket 16 for the earth is provided with the rotation restricting portion 112 as in the fifth embodiment, and mounting of the earth pin 28 in a state in which the leg portion 29 of the earth pin 28 is not reliably inserted into the earth pin mounting opening 101 of the socket body 41 or in a state of being inserted obliquely is prevented. In addition, by enabling the rotation of the earth pin 28 in the correct position of insertion in which the leg portion 29 of the earth pin 28 is inserted into the earth pin mounting opening 101 of the socket body 41, the connection between the earth pin 28 and the terminals 42 is ensured, and the earth pin 28 is prevented from dropping off the socket body 41. The configurations of the terminals 42 in the sixth and the seventh embodiments may be applied.

In addition, the rotation restricting portion 112 may be composed only of the socket body 41 or only of the terminals 42, or of the both.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST

11 luminaire
12 straight tube type lamp
16 socket
28 earth pin
29 leg portion
30 holding portion
41 socket body
42 terminal
48 insertion port
49 notched portion
52 insertion port-side inclined portion
53 guiding inclined portion
54 guiding device
57 supporting device
63 terminal strip portions
67 fitting portion
74 space portion
102 abutting portions
112 rotation restricting portion
125 projections
128 fitting openings
P holding position

The invention claimed is:

1. A socket configured to hold a straight tube type lamp including a pin including a leg portion, and a holding portion formed at a distal end of the leg portion, formed into an oval shape and having a diameter larger than that of the leg portion comprising:

a socket body including an insertion port having a dimension larger than a short diameter dimension of the oval shape of the holding portion of the pin and a notched portion communicating from the insertion port to a predetermined holding position where the pin is held and allowing the leg portion of the pin to be inserted therethrough;

a guiding device configured to guide the holding portion to the holding position by a rotation of the pin between the insertion port and the holding position; and a terminal disposed on the socket body and configured to hold the holding portion of the pin in the holding position.

2. The socket according to claim 1, wherein the guiding device is guiding inclined portions increasing the distance therebetween toward the holding position.

3. The socket according to claim 2, wherein the guiding inclined portions are formed integrally with the socket body.

4. The socket according to claim 2, wherein the guiding inclined portion is formed of part of the terminal.

5. The socket according to claim 1, wherein the guiding device includes a supporting device configured to support the terminal and an end portion of the terminal on the side of the insertion port, and is configured to generate a stress received when the holding portion of the pin deforms the terminal on the side of the holding position.

6. The socket according to claim 5, wherein a space portion which prevents the terminal from coming into contact with the socket body even when the terminal is deformed by the holding portion of the pin to the maximum is formed in the direction in which the terminal is deformed by the holding portion of the pin.

7. The socket according to claim 1, wherein the socket body includes a pair of insertion port-side inclined portions extending so as to increase the distance therebetween toward the insertion port.

8. The socket according to claim 7, wherein the minimum dimension between the pair of insertion port-side inclined portions is larger than the short diameter dimension of the holding portion of the pin and smaller than a long diameter dimension thereof.

9. The socket according to claim 1, comprising a rotation restricting portion configured to allow the rotation of the pin moved to the holding position and restrict the rotation of the pin at a position before being moved to the holding position.

10. The socket according to claim 9, wherein the notched portion includes an abutting portion having a distance smaller than the diameter of the leg portion of the pin, and providing resistance against the movement of the leg portion with respect to the holding position.

11. The socket according to claim 1, wherein the terminal includes a fitting portion where the holding portion fits by the rotation of the holding portion of the pin and projections provided at both end positions of the fitting portion corresponding to the direction of rotation of the holding portion.

12. The socket according to claim 1, wherein the terminal includes a pair of terminal strips facing a peripheral surface of the holding portion of the pin, and the pair of terminal strips each include a fitting opening configured to allow the holding portion of the pin rotating toward a mounting position to be fitted thereto.

13. A luminaire comprising:

a straight tube type lamp including a pin projecting at one end thereof and a lamp pin for power supply projecting from the other end thereof, the pin including a leg portion and a holding portion formed at a distal end of the leg portion, formed into an oval shape and having a diameter larger than the leg portion;

a socket according to claim 1, configured to allow the pin of the straight tube type lamp to be mounted therein; and a socket for power supply configured to allow the lamp pin of the straight tube type lamp to be mounted therein.

* * * * *